US007944195B2

(12) United States Patent
Jang

(10) Patent No.: US 7,944,195 B2
(45) Date of Patent: May 17, 2011

(54) START-UP CIRCUIT FOR REFERENCE VOLTAGE GENERATION CIRCUIT

(75) Inventor: Byung-Tak Jang, Seongnam-si (KR)

(73) Assignee: Dongbu HiTek Co., Ltd., Seoul (KR)

( * ) Notice: Subject to any disclaimer, the term of this patent is extended or adjusted under 35 U.S.C. 154(b) by 236 days.

(21) Appl. No.: 12/334,498

(22) Filed: Dec. 14, 2008

(65) Prior Publication Data

US 2009/0160419 A1 Jun. 25, 2009

(30) Foreign Application Priority Data

Dec. 24, 2007 (KR) ..... 10-2007-0136467

(51) Int. Cl.
*G05F 3/16* (2006.01)
*G05F 3/26* (2006.01)
*G05F 3/30* (2006.01)

(52) U.S. Cl. ..... 323/314; 323/316

(58) Field of Classification Search ..... 323/312–316
See application file for complete search history.

(56) References Cited

U.S. PATENT DOCUMENTS 6,259,240 B1 * 7/2001 Smith ..... 323/313
2004/0036460 A1 * 2/2004 Chatal ..... 323/313
2007/0096712 A1 * 5/2007 Chang ..... 323/313
2007/0194770 A1 * 8/2007 Kalyanaraman ..... 323/313

* cited by examiner

*Primary Examiner* — Adolf Berhane
*Assistant Examiner* — Fred E Finch, III
(74) *Attorney, Agent, or Firm* — Sherr & Vaughn, PLLC

(57) ABSTRACT

Embodiments relate to a start-up circuit for a reference voltage generation circuit. According to embodiments, a start-up circuit may include a start-up start unit allowing current to flow in the reference voltage generation circuit to initiate a start-up process in response to a start-up start signal, a reference current generation unit decreasing a variable voltage depending on whether the reference voltage generation circuit is started up and generating start-up reference current corresponding to the variable voltage, and a start-up controller detecting current flowing in the reference voltage generation circuit, comparing the detected result with the start-up reference current, and outputting the compared result as a start-up start signal. Current consumption may be decreased after start-up. A BRG circuit may be stably started up. If a high supply voltage is used, current consumption may decrease, and if a low supply voltage is used, a BGR circuit may be stably started up.

17 Claims, 4 Drawing Sheets

-Related Art-

START-UP CIRCUIT FOR REFERENCE VOLTAGE GENERATION CIRCUIT

The present application claims priority under 35 U.S.C. 119 to Korean Patent Application No. 10-2007-0136467 (filed on Dec. 24, 2007), which is hereby incorporated by reference in its entirety.

BACKGROUND

A band gap reference (BGR) circuit (or a reference voltage generation circuit) may be used in a design of a semiconductor circuit, and may provide a constant voltage (a reference voltage). The reference voltage may be approximately 1.1V close to a band gap voltage difference of single crystalline silicon. In a semiconductor process, an operation temperature of a chip and an applied voltage may be changed.

A BGR circuit may have both an operating point where current may not flow in an internal current path and an operating point where current may flow. Since a BGR circuit may not perform an intended operation when current may not flow, a start-up circuit that may initially allow current to flow so as to reach an intended operating point may be necessary. Since a start-up circuit may continuously operate while allowing constant current to flow after start-up, it may be beneficial that current consumption of a start-up circuit may be minimized after start-up.

A current consumption of a start-up circuit may be changed according to a variation in an external power source, a variation in a device manufacturing process, and a temperature variation. According to a process, an external power source and a temperature may be adjusted. This may decrease a current consumption when a start-up circuit is designed such that the current consumption thereof may be significantly reduced. Hence, a start-up current may be excessively decreased. Thus, a start-up time of a BGR circuit may be increased or a BGR circuit may not start up.

In contrast, an external power source and a temperature may be adjusted to increase current consumption when a start-up circuit supplies sufficient current such that a BGR circuit may rapidly start up under temperature, voltage and process conditions with low current consumption, a current consumption of a start-up circuit may increase excessively. Therefore, it may be beneficial that a large current flows at a time of start-up. This may supply current necessary for start-up. Current consumed for operating a start-up circuit may be decreased after a start-up of a BGR circuit. This may decrease a power consumption of a semiconductor device. However, even after start-up, a related art start-up circuit may consume the same relatively high current as before start-up.

Figure 1:
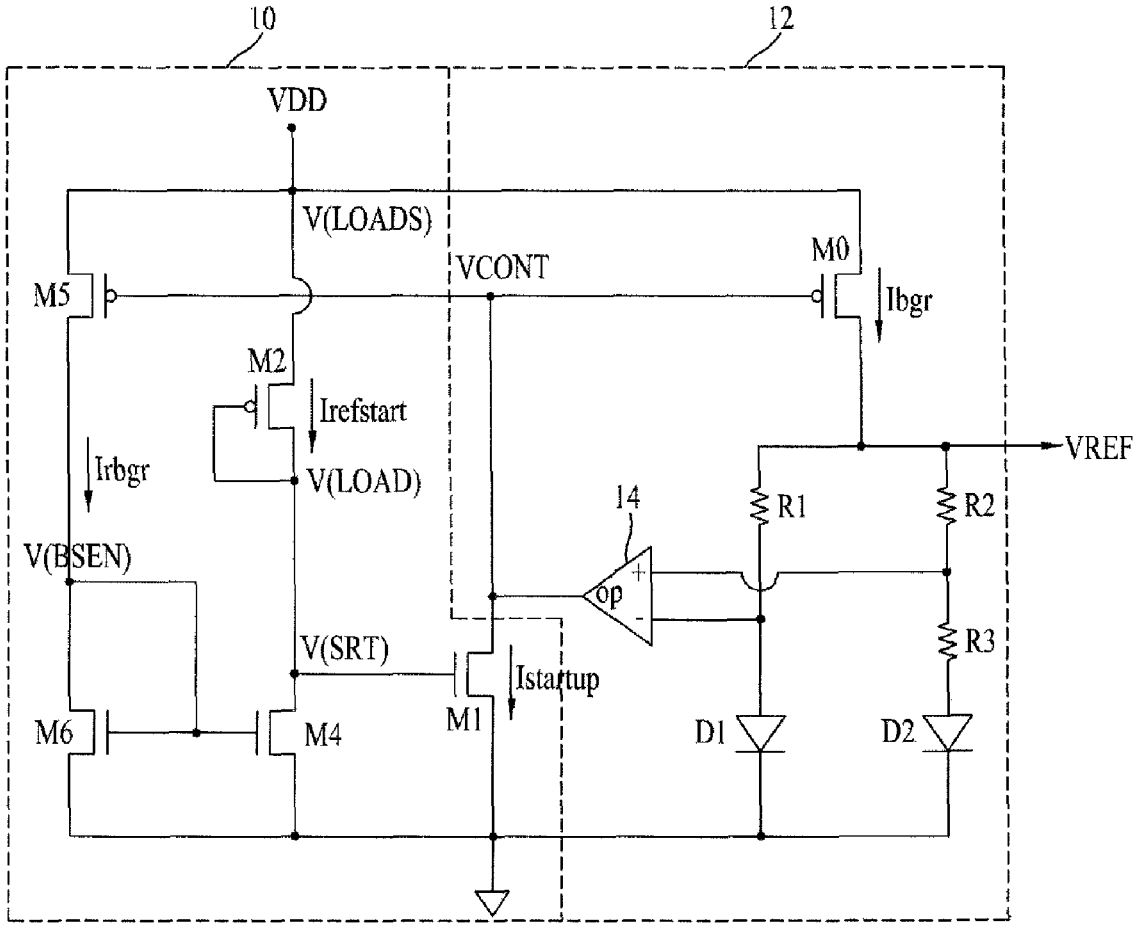

Hereinafter, an example of a related art start-up circuit for a BGR circuit will be described with reference to the accompanying drawings. FIG. 1 is a circuit diagram of a related art start-up circuit. It may include start-up circuit 10 and BGR circuit 12. Start-up circuit 10 may include transistors M1, M2, M4, M5, and M6. Since BGR circuit 12 may not change according to embodiments, an operation and a configuration of BGR circuit 12 will be described later with respect to embodiments. BGR, however, includes at least one transistor M0 and operational amplifier 14.

Referring to FIG. 1, since transistor M2 may have a diode structure in which a gate of transistor M2 may be connected to a drain thereof, current proportional to a forward voltage may flow. In a non-start-up state, transistors M0, M4, M5 and M6 may operate in a cut-off region. That is, current may not flow in BGR circuit 12. Therefore, gate voltage V(SRT) of transistor M1 may become a voltage obtained by subtracting a voltage across transistor M2 from supply voltage VDD. If supply voltage VDD is increased to about 1.5V or more, transistor M1 may turn on and a voltage VCONT may be decreased from supply voltage VDD. If voltage VCONT is decreased to a voltage lower than supply voltage VDD, transistors M0, M4, M5 and M6 may turn on and current proportional to current Ibgr may flow in start-up circuit 10.

Transistors M0, M4, M5 and M6 may be configured as a current mirror structure. At this time, if a driving current of transistor M4 becomes larger than current Irefstart supplied from transistor M2, voltage V(SRT) may be decreased and may be close to a reference voltage, for example, ground voltage (GND). Transistor M1 may be introduced into a cut-off region again. If transistor M1 is turned off, voltage VCONT may be controlled only by operational amplifier 14.

An operating point of BGR circuit 12 may be checked by changing and comparing current Irefstart flowing in transistor M2 and BGR current Ibgr flowing in transistor M0 with a predetermined ratio. At this time, a current flowing in transistor M2 may be changed according to various conditions such as a manufacturing process, temperature, supply voltage VDD, and voltage V(SRT). Since transistor M2 may have a diode structure and a current flowing in transistor M2 may be increased in proportion to a second power of a voltage across transistor M2, a variation width of current Irefstart may be significantly increased if a range of supply voltage VDD used is wide. Since voltage V(SRT) may become zero after start-up, current Irefstart may further increase as compared with before start-up and may thus continuously flow. Although a resistor may be used to reduce a dependency on supply voltage VDD, this method may not be desirable because a relatively large space may be required as compared with a transistor.

SUMMARY

Embodiments relate to a reference voltage generation circuit for generating a voltage having a substantially constant level, such as a band gap voltage. Embodiments relate to a start-up circuit for starting up a reference voltage generation circuit.

Embodiments relate to a start-up circuit for a reference voltage generation circuit, which may be capable of rapidly starting up a BGR circuit by initially allowing sufficient start-up current to flow and decreasing operation current from a time point when a start-up of a BGR circuit may be started by itself.

According to embodiments, a start-up circuit for starting up a reference voltage generation circuit for generating a reference voltage having a constant level may include at least one of the following. A start-up start unit allowing current to flow in a reference voltage generation circuit to start a start-up process in an initial stage of a start-up process in response to a start-up start signal. A reference current generation unit decreasing a variable voltage depending on whether the reference voltage generation circuit is started up and generating a start-up reference current corresponding to the variable voltage. A start-up controller detecting the current flowing in the reference voltage generation circuit, comparing the detected result with the start-up reference current, and outputting the compared result as the start-up start signal.

According to embodiments, a start-up circuit for starting up a reference voltage generation circuit, which may have an operational amplifier to decrease a voltage difference between two paths, in which different currents flow, in response to an external environment, may include at least one of the following. A first transistor connected between an output terminal of the operational amplifier and a reference voltage. A second transistor having a diode structure and connected between a supply voltage and a load voltage. A third transistor connected between the load voltage and a gate of the first transistor. A fourth transistor connected between the gate of the first transistor and the reference voltage. A fifth transistor connected between the supply voltage and a gate of the third transistor and having a gate connected to an output terminal of the operational amplifier. A sixth transistor having a diode structure and connected between the gates of the third and fourth transistors and the reference voltage.

According to embodiments, in a start-up circuit for a reference voltage generation circuit, since a function for decreasing an operating current of a start-up circuit after start-up may be added in addition to a related art start-up circuit having no function for decreasing an operating current after start-up, current consumption may be decreased compared with the related art circuit. Thus, according to embodiments, a start-up circuit may be applicable to an application requiring low power consumption.

Even if a product requiring low power consumption is designed such that a current consumption of the start-up circuit may be decreased, sufficient operating current may be used in a start-up circuit. Therefore, according to embodiments, a BRG circuit may be stably started up. Even if a use range of a supply voltage is wide, that is, even if a high supply voltage is used, a current consumption may be decreased. According to embodiments, even if a use range of a supply voltage is narrow, that is, even when a low supply voltage may be used, a BGR circuit may be stably started up.

DRAWINGS

FIG. 1 is a circuit diagram of a related art start-up circuit.

Figure 2:
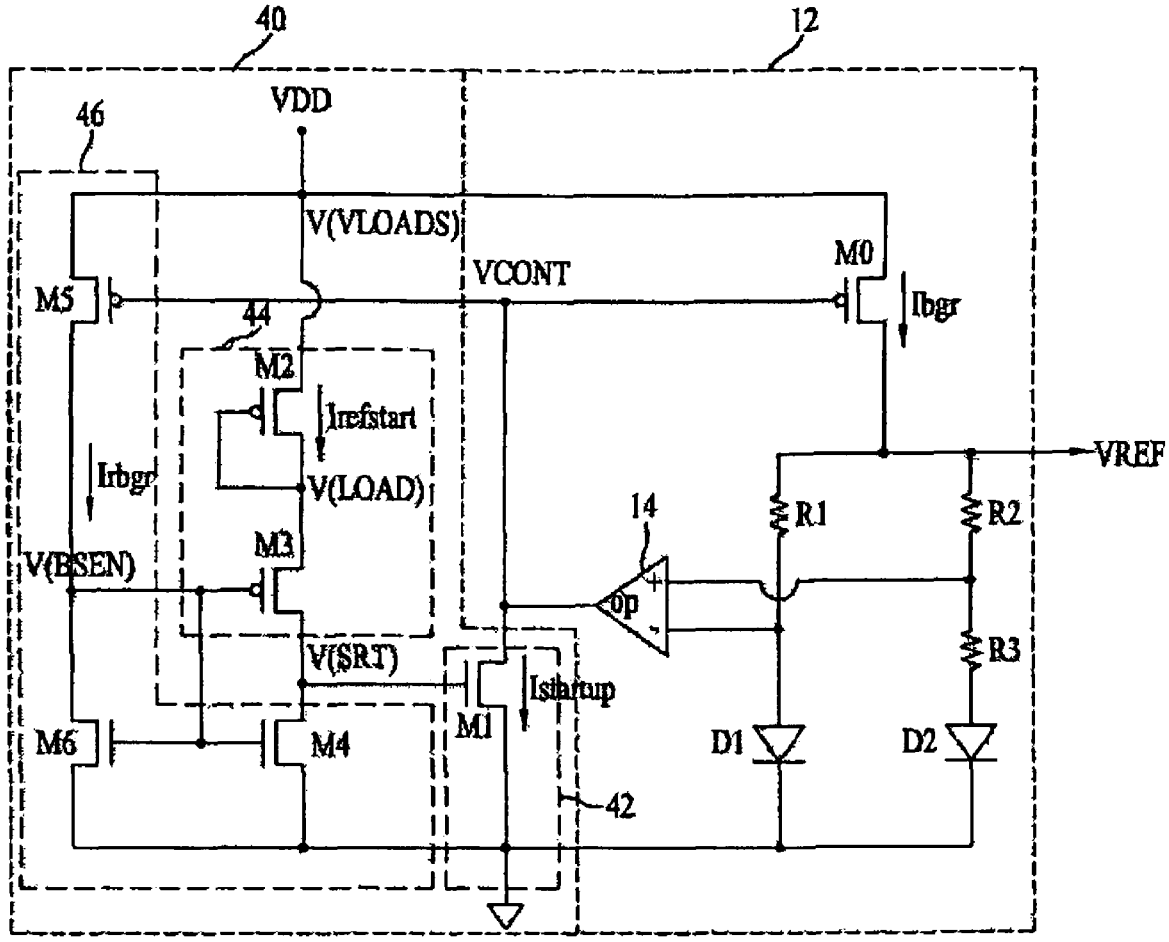
Figure 3:
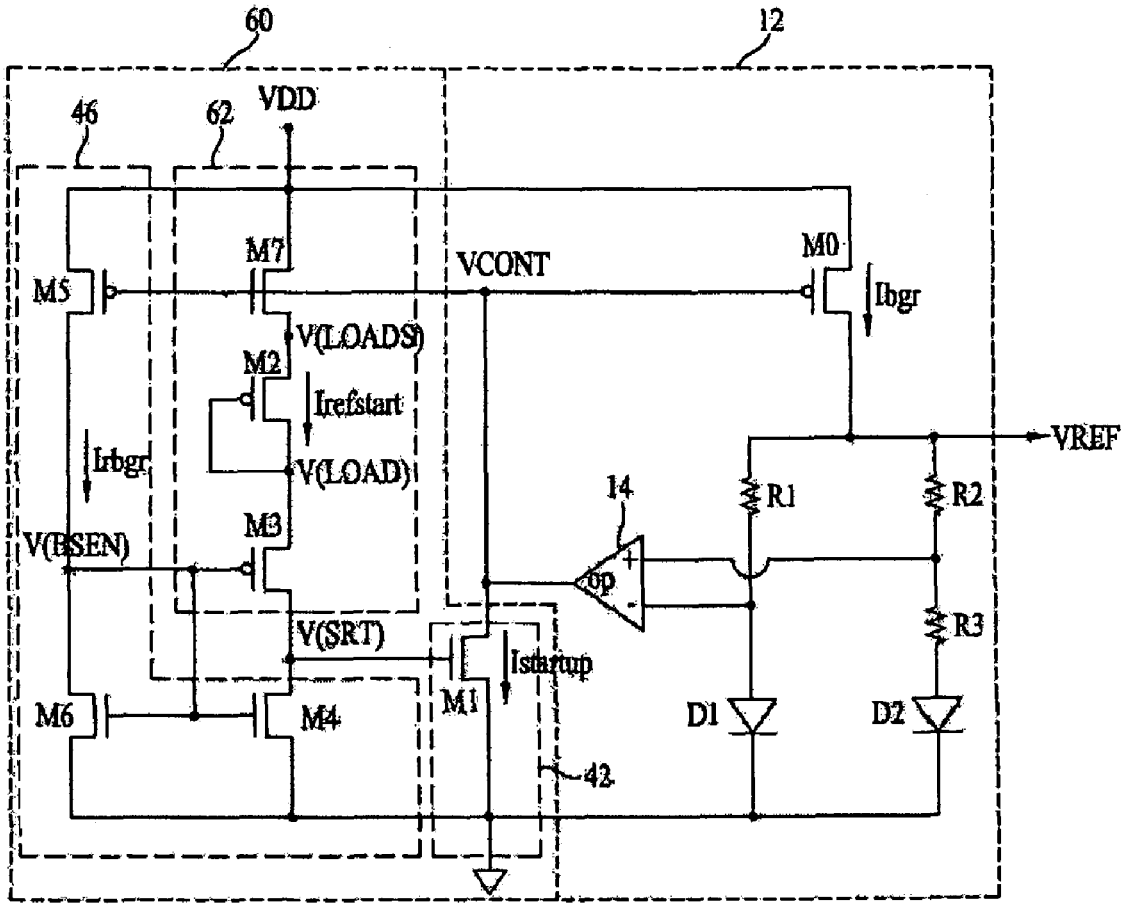

Example FIGS. 2 and 3 are circuit diagrams of start-up circuits, according to embodiments.

Figure 4:
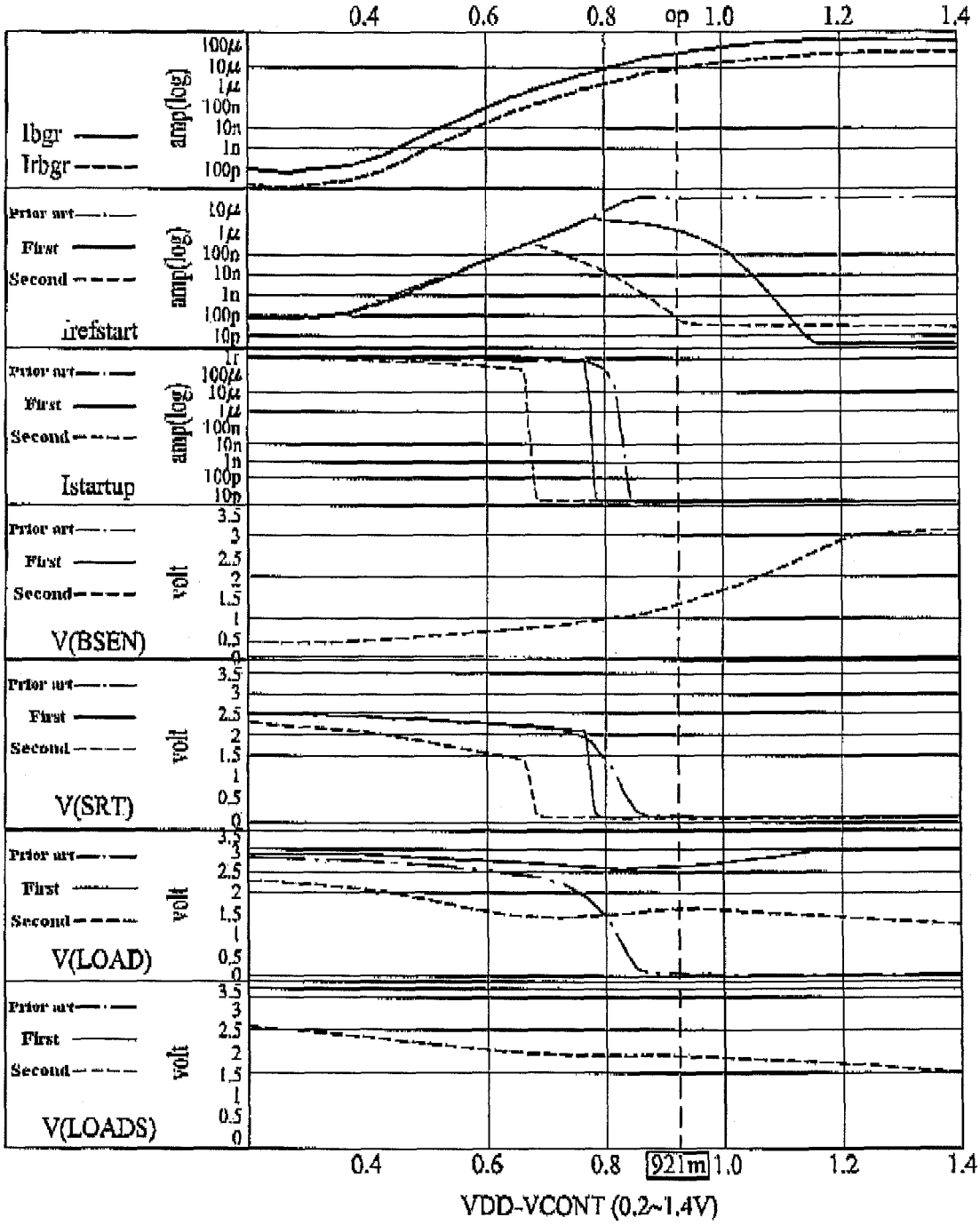

Example FIG. 4 is a waveform diagram of units of start-up circuits illustrated in FIG. 1 and example FIGS. 2 and 3.

DESCRIPTION

Example FIGS. 2 and 3 are circuit diagrams of start-up circuits 40 and 60, according to embodiments. Start-up circuits 40 and 60 and a reference voltage generation circuit 12 are shown.

Reference voltage generation circuit 12 may generate a reference voltage having a constant level regardless of external influence. Reference voltage generation circuit 12 may become a band gap reference (BGR) circuit, which may generate a constant voltage of approximately 1.1 volts, which may be equal to a silicon band gap voltage. Reference voltage generation circuit 12 may use an operational amplifier to decrease a voltage difference between two paths in which different currents may flow in response to an external environment.

According to embodiments, a start-up circuit may include start-up start unit 42, reference current generation unit 44 or 62 and start-up controller 46.

Start-up start unit 42 may initially allow current to flow to reference voltage generation circuit 12 in response to start-up start signal V(SRT). This may initiate a start-up of reference voltage generation circuit 12. Reference current generation unit 44 may decrease a variable voltage depending on whether or not reference voltage generation circuit 12 is started up and may generate start-up reference current Irefstart corresponding to the variable voltage. Start-up controller 46 or 62 may detect a current flowing in reference voltage generation circuit 12, may compare the detected result Irbgr with start-up reference current Irefstart, and may output a compared result to start-up start unit 42 as start-up start signal V(SRT).

According to embodiments, for ease in explanation, it may be assumed that reference voltage generation circuit 12 is a BGR circuit to facilitate the understanding of units 42, 44 and 46 of start-up circuit 40. According to embodiments, other circuits could be used, for example various reference voltage generation circuits 12 could be used. BGR circuit 12 may also be variously implemented. A configuration and an operation of BGR circuit 12 will be described with reference to the accompanying drawings.

An operation principle of BGR circuit 12 will be briefly described. If a same current flows in diodes D1 and D2 having different sizes, voltages across diodes D1 and D2 may be different from each other. Difference ΔV between the different voltages may be expressed by Equation 1.

$$\Delta V = \frac{\eta kT}{q}\ln(m2/m1) \qquad \text{Equation 1}$$

where, η denotes an ideal factor of the diode, k denotes Plank's constant, T denotes Kelvin temperature, q denotes a unit charge amount, m2/m1 denotes the area ratio of the diodes D2 and D1. The area ratio (m2/m1) is larger than 1.

From Equation 1, voltage ΔV may be proportional to temperature T. In example FIGS. 2 and 3, BGR circuit 12 may include resistors R1, R2 and R3, diodes D1 and D2, operational (OP) amplifier 14, and transistor M0. One end of resistors R1 and R2 may be connected to common node VREF. Current Ibgr may be adjusted by an operation of operational amplifier 14 and may eliminate a voltage difference between resistors R1 and R2. If a values of resistors R1 and R2 are equal, voltages of a positive terminal and a negative terminal of operational amplifier 14 may be equal. Hence a same current may flow in resistors R1 and R2 and a same current may flow in diodes D1 and D2.

According to embodiments, a voltage difference proportional to an area ratio of diodes D1 and D2 may be applied across resistor R3. Therefore, currents flowing in diodes D1 and D2 of BGR circuit 12 may be determined by resistor R3 and ΔV defined in Equation 1. If it is assumed that a value of resistor R3 is not significantly changed according to temperature and voltage, a value ΔV/R3 may be proportional to ΔV. That is, if ΔV is a function of temperature, BGR current Ibgr may also become a function of temperature. Since current Ibgr may flow in resistors R1 and R2, voltages across resistors R1 and R2 may be proportional to temperature. According to embodiments, if constant current is applied to the diode and a temperature is changed, a voltage across the diode may be changed according to Equation 2.

$$I = I_o e^{\frac{q \cdot V}{\eta kT}} \qquad \text{Equation 2}$$

$I_0$ may be a constant determined according to a diode. In Equation 2, V and T may be respectively included in a dominator and a numerator of an exponential term and thus may be inversely proportional to each other. That is, if constant current is applied and temperature is increased, a voltage across the diode may decrease.

Reference voltage VREF output from BGR circuit 12 may be a sum of a voltage across resistor R1 and a voltage across diode D1. Therefore, if resistor R1 is selected such that temperature changes of two voltage values may be canceled, reference voltage VREF may have a constant value regardless of temperature. This may be because a voltage across resistor R1 may be proportional to temperature and a voltage across diode D1 may be inversely proportional to temperature. If a current does not flow in diodes D1 and D2, both voltages of positive and negative input terminals of operational amplifier 14 may become zero. According to embodiments, a difference between the input voltage may become zero.

According to embodiments, BGR circuit 12 may be at one operating point. That is, when current may not flow in diodes D1 and D2, operational amplifier 14 may operate such that the same state may be maintained. According to embodiments, to allow a current to flow in the two current paths of BGR circuit 12, start-up circuit 40 may be necessary. Immediately after power may be applied, BGR circuit 12 may be at an operating point in which current may not flow. In this state, voltage VCONT may be equal to supply voltage VDD and transistor MO may operate in a cut-off region. This may block a flow of current. Start-up circuit 40 may change this state.

A configuration and an operation of start-up circuit 40 according to embodiments will next be described. According to embodiments, start-up circuit 40 may include transistors M1 through M6.

According to embodiments, start-up start unit 42 may be implemented by first transistor M1, which may have a drain and a source connected between a control voltage to initiate a start-up of reference voltage generation circuit 12 and a reference voltage. Transistor M1 may also have a gate connected to start-up start signal V(SRT). A control voltage may be an output voltage of operational amplifier 14 and a reference voltage may be a ground voltage.

According to embodiments, as shown in example FIG. 2, reference current generation unit 44 may be implemented by transistors M2 and M3. According to embodiments, second transistor M2 may have a source and a drain connected between supply voltage VDD and load voltage V(LOAD) and a gate connected to load voltage V(LOAD). According to embodiments, start-up reference current Irefstart may flow in second transistor M2. According to embodiments, third transistor M3 may have a source and a drain connected between load voltage V(LOAD) and start-up start signal V(SRT) and a gate, which may be connected to receive a result of detecting a current of BGR circuit 12. In example FIG. 2, a variable voltage may correspond to a voltage difference between a source and a drain of second transistor M2.

According to embodiments, start-up controller 46 may include transistors M4, M5 and M6. According to embodiments, fourth transistor M4 may have a drain and a source connected between a gate of first transistor M1 and a reference voltage, and may have a gate connected to a gate of third transistor M3. According to embodiments, fifth transistor M5 may have a source and a drain connected between supply voltage VDD and a gate of third transistor M3. Fifth transistor M5 may have a gate connected to an output voltage of operational amplifier 14, which may be a control voltage. According to embodiments, sixth transistor M6 may have a drain and a source connected between a gate of third transistor M3 and a reference voltage, and may have a gate connected to a gate of fourth transistor M4. A result Irbgr of detecting a current of BGR circuit 12 may indicate a current flowing from fifth transistor M5 to sixth transistor M6. Start-up start signal V(SRT) may correspond to a drain voltage of fourth transistor M4.

According to embodiments, as shown in example FIG. 3, reference current generation unit 62 may be implemented by transistors M2, M3 and M7. That is, reference current generation unit 62 may be configured by adding transistor M7 to reference current generation unit 44. According to embodiments, seventh transistor M7 may have a drain and a source connected between supply voltage VDD and second transistor M2 and may have a gate connected to an output voltage of operational amplifier 14, which may be a control voltage.

An operation of start-up circuit 40 having the above-described configuration will now be described, according to embodiments.

According to embodiments, if power is applied, an operating point of BGR circuit 12 may be in a state in which current may not flow. To change this state, voltage VCONT may be adjusted to be lower than supply voltage VDD. If a flow of current starts, a difference between voltages across diodes D1 and D2 may be generated. According to embodiments, operational amplifier 14 may operate such that a voltage difference may be decreased and BGR circuit 12 may become stable at a different operating point in which current may flow. According to embodiments, start-up circuit 40 or 60 may decrease a gate voltage VCONT of transistor MO when BGR circuit 12 may be at an operating point in which current may not flow and may not influence a gate voltage of transistor M0 after BGR circuit 12 is moved to an operating point in which current may flow.

An operation of a start-up circuit after start-up will now be described. An operation of a start-up circuit during start-up will be described later with reference to the waveform diagram. According to embodiments, transistor M3 may be further included, unlike a related art circuit shown in FIG. 1. According to embodiments, if duplicated current Irbgr, which may be proportional to current Ibgr, flows in transistors M5 and M6 after start-up, voltage V(BSEN) may become higher than a threshold voltage of transistor M6. According to embodiments, source voltage V(LOAD) of transistor M3 may be a sum of voltage V(BSEN) and a threshold voltage of transistor M3.

According to embodiments, in start-up circuit 10 shown in FIG. 1, supply voltage VDD may be applied across transistor M2. However, in start-up circuit 40 shown in example FIG. 2, after start-up, a voltage obtained by subtracting a threshold voltage of transistor M6 and a threshold voltage of transistor M3 from supply voltage VDD may be applied across transistor M2. According to embodiments, a level of load voltage V(SRT) at a time point when reference voltage generation circuit 12 may be started up by itself may be increased by a sum of threshold voltages of third and sixth transistors M3 and M6, as compared with FIG. 1. According to embodiments, current Irefstart flowing in transistor M2 may be decreased as compared with FIG. 1.

Referring to example FIG. 3, transistor M7 may be further added. Load voltage V(LOAD) connected to a gate and drain of transistor M2 may be obtained in a manner similar to that described with respect to example FIG. 2. In example FIG. 2, voltage V(VLOADS) of a source node of transistor M2 may be maintained at supply voltage VDD regardless of whether or not BGR circuit 12 is started up. According to embodiments, in example FIG. 3, before start-up, voltage V(VLOADS) may be voltage VDD-VTN, which may be obtained by subtracting threshold voltage VTN of transistor M7 from supply voltage VDD. According to embodiments, after start-up, since a gate voltage of transistor M7 may be decreased from supply voltage VDD to less than a threshold voltage of transistor M0, voltage V(VLOADS) may be moved by a voltage corresponding to the change. According to embodiments, if reference voltage generation circuit 12 is started up by itself, a level of voltage supplied to a source of second transistor M2 may be decreased by a threshold voltage of seventh transistor M7. According to embodiments, a variable voltage may be further decreased, as compared with FIG. 1 or example FIG. 2. According to embodiments, start-up circuit 60 shown in FIG. 3 may further decrease current Irefstart after start-up, as compared with start-up circuit 40 shown in example FIG. 2.

Hereinafter, an operation of a related art start-up circuit shown in FIG. 1 and starting circuits 40 and 60 shown in example FIGS. 2 and 3 will be described with reference to a waveform diagram of currents and voltages of the terminals. An operation may be described until a point where BRG circuit 12 may be started up and after BRG circuit 12 is started up, according to embodiments.

Example FIG. 4 is a waveform diagram of units of start-up circuits 10, 40 and 60 shown in FIGS. 1 through 3. To obtain waveforms shown in example FIG. 4, a simulation may have been performed where supply voltage VDD may be 3.3 volts and a difference between supply voltage VDD and voltage VCONT may be adjusted in a range of approximately 0.2V to 1.4V. BGR circuit 12 may be continuously maintained at an operating point by an operation of operational amplifier 14 after start-up, According to embodiments, in this simulation, voltage VCONT may be directly applied by an external device regardless of an operation of operational amplifier 14. This may allow for an observation of a change of a start-up circuit due to a change of voltage VCONT.

According to embodiments, an operating point maintained by an operation of operational amplifier 14 may be a point in which a difference VDD-VCONT may be 0.92V, and may be denoted by a dotted line which is vertically drawn in example FIG. 4. According to embodiments, in the waveforms, unless otherwise stated, a dashed-dotted line corresponds to related art, a solid line corresponds to embodiments and a dotted line corresponds to embodiments. The waveforms may be measured by gradually decreasing voltage VCONT from supply voltage VDD. A vertical axis of a current waveform may be shown by a log scale and a vertical axis of a voltage waveform may be shown by a linear scale.

In a first waveform shown in example FIG. 4, since BGR current Ibgr flowing in transistor M0 of BGR circuit 12 and the current Irbgr obtained by duplicating BGR current Ibgr with a constant ratio may be equal in the related art and embodiments, only waveforms of currents Ibgr and Irbgr of the related art shown in FIG. 1 are shown.

Current Irbgr may be obtained by duplicating current Ibgr with a constant ratio, for example, approximately ⅕. According to embodiments, as a difference VDD-VCONT may be increased, currents Ibgr and Irbgr may be exponentially increased in a vicinity of 0.5V, which may be threshold voltage Vth of transistors M0 and M5. If difference VDD-VCONT is 0.8V or more, transistors M0 and M5 may be turned on and thus a current may be substantially linearly increased. A current proportional to $(Vgs-Vth)^2$ may flow in a MOS transistor in a turn-on state. According to embodiments, this may be a state in which voltage Vgs between a gate and source may be higher than threshold voltage Vth. Since a vertical axis may be shown by a log scale in this waveform, current may increase exponentially in a straight-line section, and current may be substantially linearly increased in a section in which a line may be slowly increased while an inclination may be reduced.

In a second waveform shown in example FIG. 4, current Irefstart may be used when the initial start-up of BGR circuit 12 using a start-up circuit may be finished, compared with current Irbgr. Current Irefstart may be restricted by fourth transistor M4 when difference VDD-VCONT may be small, may increase exponentially along the current Irbgr, and may no longer increase when reaching a start-up reference current Irefstart determined by a BGR state, a supply voltage, and reference current generation unit 44 or 62.

According to embodiments, current may be lower than start-up reference current Irefstart while current Irefstart may exponentially increase, and may no longer increase and may become equal to a start-up reference current from a time point when current Istartup may rapidly decrease. If start-up reference current Irefstart is set to be too low, start-up of BGR circuit 12 may be delayed or may not be performed. According to embodiments, if start-up reference current Irefstart is set to be too high, a normal operation of BGR circuit 12 may not be performed. According to embodiments, current Irefstart may be decreased after start-up. This may be because a start-up reference current may be decreased by applying a BGR state, that is, voltage VCONT and current Ibgr, unlike the related art.

According to the related art, current Irefstart may exponentially increase as difference VDD-VCONT may increase. Current Irefstart may then be maintained at a constant value, that is, a start-up reference current, from a voltage for disallowing current Istartup from flowing. This may be because the BGR state may not be applied in the related art.

According to embodiments, current Irefstart may exponentially increase and may gradually decrease from a voltage that may disallow current Istartup from flowing. According to embodiments, a current may decrease more rapidly from a voltage that may disallow current Istartup from flowing.

Current Irefstart may increase exponentially and may then decrease or be maintained. The related art and embodiments may be different from each other in voltage VCONT for rapidly decreasing current Istartup and current Irefstart at this voltage, but voltage VCONT and current Irefstart may be partially adjusted by a design. Therefore, the related art and embodiments may be different from each other in a variation amount of current Irefstart after current Istartup may be rapidly decreased.

Although the related art and embodiments may be designed such that current Istartup may rapidly decrease at a same voltage VCONT, in a process of moving voltage VCONT to an operating point by an operation of operational amplifier 14, a same current may be maintained in the related art and current Irefstart may gradually decrease, according to embodiments. By this operation, a current of start-up circuit 40 or 60 may be decreased in a method according to embodiments.

In a third waveform of example FIG. 4, current Istartup of transistor M1, which may be a start-up current for starting up BGR circuit 12, is shown. According to the related art and embodiments, if difference VDD-VCONT is low, high current Istartup of approximately 1 mA which may be enough for a start-up of the BGR may flow, may rapidly decrease in a vicinity of 0.7V, and may hold at a very low value of 100 pA or less. If current Istartup is sufficiently low, an operation of operational amplifier 14 may not be influenced. Start-up circuit 10, 40, or 60 may cause a start-up of operational amplifier 14 if operational amplifier 14 is not moved to an operating point by itself at a time of start-up. However, if a time point when operational amplifier 14 may start a start-up process by itself is reached, an operation of start-up circuit 10, 40, or 60 may be stopped and operational amplifier 14 may be moved to an operating point by itself.

A time point when a start-up process may be started may indicate a time point when difference VDD-VCONT may be higher than a threshold voltage of transistors M0 and M5. According to embodiments, in a start-up process, a start-up may be performed by start-up circuit 12, 40, or 60 in an initial stage of a start-up process. The start-up may be completed by an operation of operational amplifier 14 in a latter stage of a start-up process.

In an initial stage of a start-up process, a start-up circuit may allow current to flow from node VCONT to ground voltage GND such that voltage VCONT may be decreased to voltage VDD-Vth. Thereafter, start-up current Istartup may be decreased to a value which may be close to zero by start-up circuit 10, 40, or 60 in a constant range. Thus an operation of start-up circuit 10, 40, or 60 may be completed. Start-up circuit 10, 40, or 60 may repeatedly perform such an operation when a start-up process is required after an operation of BGR circuit 12 ceases due to power-down. Even if an operation of BGR circuit 12 is stopped due to an expected factor such as power source noise, start-up circuit 10, 40, or 60 may start up BGR circuit 12 such that a stable operation of BGR circuit 12 may be secured.

In a fourth waveform of example FIG. 4, voltage V(BSEN) may have substantially a same waveform as the related art and embodiments. A waveform of voltage V(BSEN) may be obtained because current Irbgr may flow in transistor M6, which may have a diode structure.

In a fifth waveform of example FIG. 4, if current Irbgr is lower than a start-up current, voltage V(SRT) may be maintained at 1V or more and transistor may be turned on. However, if current Irbgr becomes higher than start-up reference current, voltage V(SRT) may rapidly decrease to zero and transistor M1 may be turned off.

In a sixth waveform of example FIG. 4, according to embodiments, voltage V(LOAD) may gradually increase and may become stable after current Istartup may rapidly decrease. According to embodiments, since a source of transistor M2 may be fixed to supply voltage VDD, current Irefstart may decrease if a drain voltage V(LOAD) of transistor M2 increases. According to embodiments, voltage V(LOAD) may significantly increase because current Irefstart may more rapidly decrease.

In a seventh waveform of example FIG. 4, source voltage V(VLOADS) of transistor M2 may be fixed to supply voltage VDD in the related art and embodiments. According to embodiments, however, source voltage V(VLOADS) of transistor M2 may be connected to a source of transistor M7, and may be influenced by gate voltage VCONT of transistor M7. If transistors M0 and M5 turn on, voltage V(VLOADS) may decrease by a threshold voltage of transistors M0 and M5. However, after current Istartup rapidly decreases, voltage V(VLOADS) may be maintained or decreased. Voltage V(VLOADS) may continuously decrease if voltage VCONT is decreased, but voltage V(VLOADS) may not significantly decrease by a decrease of current Irefstart. In contrast, according to embodiments, an effect of decreasing current Irefstart of transistor M2 may be large.

Since start-up current Istartup may decrease from a time point when an operation of start-up circuit 40 or 60 may be completed to a time point when an operating point may be reached, start-up circuit 40 or 60 shown in example FIGS. 2 and 3 may consume a relatively low current after a start-up process even though a start-up reference current is set to be high.

In the related art, however, a current consumption may increase when a design is made such that sufficient start-up current may be secured. Therefore, in the related art, there may be a need for a negotiation about a start-up reference current and a stable start-up operation.

According to embodiments, however, a power consumption may be reduced although sufficient start-up reference current may be secured.

It will be obvious and apparent to those skilled in the art that various modifications and variations can be made in the embodiments disclosed. Thus, it is intended that the disclosed embodiments cover the obvious and apparent modifications and variations, provided that they are within the scope of the appended claims and their equivalents.

What is claimed is:

1. A device, comprising:

a start-up start unit configured to allow current to flow in a reference voltage generation circuit to initiate a start-up process in an initial stage of the start-up process in response to a start-up start signal;

a reference current generation unit configured to decrease a variable voltage depending on whether or not the reference voltage generation circuit is started up and generate a start-up reference current corresponding to the variable voltage; and a start-up controller configured to detect a current flowing in the reference voltage generation circuit, compare the detected current with the start-up reference current, and output a compared result as the start-up start signal, wherein the start-up start unit comprises a first transistor having a drain and a source connected between a control voltage to initiate the start-up process of the reference voltage generation circuit, wherein a reference voltage and a gate are connected to receive the start-up start signal, and wherein the reference current generation unit comprises:

a second transistor having a source and a drain connected between a supply voltage and a load voltage, and a gate connected to the load voltage, the start-up reference current flowing in the second transistor; and a third transistor having a source and a drain connected between the load voltage and the start-up start signal, and a gate connected to the detected current, wherein the variable voltage comprises a difference between voltages across the source and the drain of the second transistor.

2. The device of claim 1, wherein the start-up controller comprises:

a fourth transistor having a drain and a source connected between the gate of the first transistor and the reference voltage, and a gate connected to the gate of the third transistor;

a fifth transistor having a source and a drain connected between the supply voltage and the gate of the third transistor, and a gate connected to the control voltage; and a sixth transistor having a drain and a source connected between the gate of the third transistor and the reference voltage, and a gate connected to the gate of the fourth transistor.

3. The device of claim 2, wherein the detected current comprises a current flowing from the fifth transistor to the sixth transistor, and the start-up start signal comprises a drain voltage of the fourth transistor.

4. The device of claim 2, wherein when the reference voltage generation circuit is started up, a level of the load voltage is increased by a sum of threshold voltages of the third and sixth transistors.

5. The device of claim 1, wherein the reference current generation unit comprises a seventh transistor having a drain and a source connected between the supply voltage and the second transistor, and a gate connected to the control voltage.

6. The device of claim 5, wherein, when the reference voltage generation circuit is started up, a level of the voltage supplied to the source of the second transistor becomes lower by a threshold voltage of the seventh transistor.

7. A device, comprising:

an operational amplifier;

a first transistor connected between an output terminal of the operational amplifier and a reference voltage;

a second transistor having a diode structure and connected between a supply voltage and a load voltage;

a third transistor connected between the load voltage and a gate of the first transistor;

a fourth transistor connected between the gate of the first transistor and the reference voltage;

a fifth transistor connected between the supply voltage and a gate of the third transistor and having a gate connected to an output terminal of the operational amplifier; and a sixth transistor having a diode structure and connected between gates of the third and fourth transistors and the reference voltage.

8. The device of claim 7, comprising a seventh transistor connected between the supply voltage and the second transistor, and having a gate connected to the output terminal of the operational amplifier.

9. The device of claim 7, wherein the operational amplifier is configured to decrease a voltage difference between two paths, in which different currents flow, in response to an external environment condition.

10. A method, comprising:

initiating a start-up process by allowing current to flow in a reference voltage generation circuit in an initial stage of the start-up process in response to a start-up start signal using a start-up start unit;

decreasing a variable voltage depending on whether or not the reference voltage generation circuit is started up and generating a start-up reference current corresponding to the variable voltage using a reference current generation unit;

detecting a current flowing in the reference voltage generation circuit, comparing the detected current with the start-up reference current, and outputting a compared result as the start-up start signal using a start-up controller;

providing an operational amplifier;

providing a first transistor connected between an output terminal of the operational amplifier and a reference voltage;

providing a second transistor having a diode structure and connected between a supply voltage and a load voltage;

providing a third transistor connected between the load voltage and a gate of the first transistor;

providing a fourth transistor connected between the gate of the first transistor and the reference voltage;

providing a fifth transistor connected between the supply voltage and a gate of the third transistor and having a gate connected to an output terminal of the operational amplifier; and providing a sixth transistor having a diode structure and connected between gates of the third and fourth transistors and the reference voltage.

11. The method of claim 10, wherein the start-up start unit comprises a first transistor having a drain and a source connected between a control voltage to initiate the start-up process of the reference voltage generation circuit, wherein a reference voltage and a gate connected to receive the start-up start signal.

12. The method of claim 11, wherein the reference current generation unit comprises:

a second transistor having a source and a drain connected between a supply voltage and a load voltage, and a gate connected to the load voltage, the start-up reference current flowing in the second transistor; and a third transistor having a source and a drain connected between the load voltage and the start-up start signal and a gate connected to the detected current, wherein the variable voltage comprises a difference between voltages across the source and the drain of the second transistor.

13. The method of claim 12, wherein the start-up controller comprises:

a fourth transistor having a drain and a source connected between the gate of the first transistor and the reference voltage, and a gate connected to the gate of the third transistor;

a fifth transistor having a source and a drain connected between the supply voltage and the gate of the third transistor, and a gate connected to the control voltage; and a sixth transistor having a drain and a source connected between the gate of the third transistor and the reference voltage, and a gate connected to the gate of the fourth transistor.

14. The method of claim 13, wherein the detected current comprises a current flowing from the fifth transistor to the sixth transistor, and the start-up start signal comprises a drain voltage of the fourth transistor.

15. The method of claim 13, comprising increasing a level of the load voltage by a sum of threshold voltages of the third and sixth transistors when the reference voltage generation circuit is started up.

16. The method of claim 12, wherein the reference current generation unit comprises a seventh transistor having a drain and a source connected between the supply voltage and the second transistor, and a gate connected to the control voltage.

17. The method of claim 16, comprising lowering a level of the voltage supplied to the source of the second transistor by a threshold voltage of the seventh transistor when the reference voltage generation circuit is started up.

* * * * *